US009359771B1

(12) United States Patent
Delforte

(10) Patent No.: US 9,359,771 B1
(45) Date of Patent: Jun. 7, 2016

(54) REMOVABLE HIGHLY SECURED WALL PANEL MOUNTING SYSTEM

(71) Applicant: Paul Delforte, Victor, NY (US)

(72) Inventor: Paul Delforte, Victor, NY (US)

(73) Assignee: Delforte Sales, Inc., Victor, NY (US)

( * ) Notice: Subject to any disclaimer, the term of this patent is extended or adjusted under 35 U.S.C. 154(b) by 0 days.

(21) Appl. No.: 14/726,829

(22) Filed: Jun. 1, 2015

(51) Int. Cl.
*E04F 13/08* (2006.01)

(52) U.S. Cl.
CPC ..... *E04F 13/081* (2013.01); *E04F 13/083* (2013.01); *E04F 13/0891* (2013.01)

(58) Field of Classification Search
CPC ... E04F 13/083; E04F 13/081; E04F 13/0882; E04F 13/0803; Y10S 52/13
See application file for complete search history.

(56) References Cited

U.S. PATENT DOCUMENTS 4,744,189 A 5/1988 Wilson
4,796,397 A 1/1989 Capaul
5,172,504 A * 12/1992 De Maat ..... G09F 7/18 40/605
5,974,753 A 11/1999 Hsu
7,805,899 B2 10/2010 Montgomery
8,127,507 B1 * 3/2012 Bilge ..... E04F 13/0814 52/235
8,407,955 B2 4/2013 Delforte
8,511,014 B2 * 8/2013 Delforte ..... E04B 2/00 52/235
8,991,127 B2 * 3/2015 Todd ..... E04F 13/0805 52/235
9,181,711 B2 * 11/2015 Bordener ..... E04F 13/0803

* cited by examiner

*Primary Examiner* — Rodney Mintz
*Assistant Examiner* — Daniel Kenny
(74) *Attorney, Agent, or Firm* — Tracy Jong Law Firm; Tracy P. Jong; Cheng Ning Jong

(57) ABSTRACT

A removable wall panel mounting system for mounting a wall panel to a wall, the wall panel having a front face, a rear face and a first attachment portion attached to a portion of the rear face thereof, including a second attachment portion, a bottom support bracket, a hook, a rail configured for attachment to the wall and a securing plate having a front surface and a rear adaptor configured to be removably and slideably attachable to the rail, the second attachment portion disposed on the securing plate. The first attachment portion is configured to be removably attachable to the second attachment portion by a pushing force applied substantially normal to the wall on the front face of the wall panel. The hook is configured to be coupled with the bottom support bracket such that a portion of the weight of the wall panel is supported via the hook.

16 Claims, 10 Drawing Sheets

REMOVABLE HIGHLY SECURED WALL PANEL MOUNTING SYSTEM

BACKGROUND OF THE INVENTION

1. The Field of the Invention

The present invention is directed generally to a wall panel mounting system, and more particularly, to a removable highly secured wall panel mounting system that is installable and removable by hand.

2. Background Art

Wall coverings have been in use for many years to decorate walls, hide imperfections, provide acoustical and thermal insulation, and protect walls from moisture and impact damage. Conventional wall coverings such as wall paper, paint and nailed-on wood or screwed-on synthetic panels are used in many residential and commercial applications. However, there are many well-known drawbacks to these prior art wall covering solutions. In order to remove a permanently nailed-on wall panel, a pry bar is conventionally used. The use of a pry bar causes dents and divots in underlying walls. Permanently screwed-on panels typically require overlaps in order to conceal screws or other fastening devices from plain sight. A system employing overlapped panels is plagued by the need to install or remove the panels in a fixed order. Therefore, removal and replacement of a damaged panel involves an undue amount of time, effort and labor cost.

Some panel mounting systems have been invented, but they suffer from insecure attachment. The wall panels become easily detached when bumped or knocked with any reasonable amount of force.

Another drawback of wall panels installed by nails and screws is a potential health hazard. Wall panels installed with their rear face coming in abutment with the underlying walls tend to trap moisture between the panel and wall, encouraging mold growth.

Several individually removable wall panel mounting solutions have been attempted to solve several of the above problems. However, none of the prior art discloses a satisfactory solution where moisture build-up is inhibited while wall panels can be securely attached to a wall without risk of intentional or accidental detachment.

U.S. Pat. No. 4,744,189 to Wilson discloses a decorative wall panel including a fabric covering on a board removably secured to an existing wall. The rear of the board carries a plurality of "VELCRO" fasteners for cooperation with corresponding fasteners on the wall. The panels may be easily secured to the wall, such as a dry wall partition, and may be just as easily removed whenever desired. The '189 disclosure fails to teach a removably attachable wall panel covering system that is tamper resistant. In column 1 lines 10-11 of the '189 patent, it has been disclosed that the removable wall panel can be conveniently removed from the wall by a simple pulling action. As such, a panel according to the '189 disclosure may only be used in a low traffic area for fear of accidental detachment and falling of a panel. It is further disclosed that the panels are secured to walls with fibrous fasteners which are relatively low in tensile attachment strength. As such, relatively large patches of such fibrous fasteners are required to provide adequate attachment to walls. Large patches of fibrous fasteners require large adhesive attachment surfaces which can present significant challenges to their complete removal once they are no longer required.

U.S. Pat. No. 5,974,753 to Hsu discloses a wall panel mounting system including prefabricated T-shaped (in cross section) horizontal supporting strips, L-shaped horizontal supporting strips, L-shaped end-locking strips and decorative panels. The end-locking strips interact with the horizontal strips and the decorative panels, provide an aesthetic appearance to the finished system when assembled on a wall and provide safety by covering the exposed ends of the T-shaped horizontal strips. In use, the wall paneling system may be easily and conveniently installed onto existing walls by a user without professional assistance and may be just as easily and conveniently removed from the wall whenever it is desired to inspect behind the panels, change the decor, or to remove the panels for installation at another location. The '753 patent also discloses a paneling system having panels that can be removed quickly and easily as disclosed in column 9 lines 28-30 of the same. It is further disclosed in column 3 lines 10-11 of the same that hook and loop fasteners are used to secure panels to strips secured to walls. The '753 patent fails to teach a removable panel system that is capable of preventing accidental detachment nor does it teach a safety measure to prevent dropping of a panel upon detaching from a wall. The proposed application for the system disclosed in '753 is for residential use in basements which are typically not exposed to high traffic or use.

U.S. Pat. No. 4,796,397 to Capaul discloses a demountable acoustical panel structure having a honeycomb core, and a thin, dense, sound transmitting glass fiber sheet of uniform thickness adhered to each of the opposed major surfaces of the core. One of the thin sheets advantageously carries segments or patches of a separable fastening means to enable the panel structure to be installed on a supporting surface provided with cooperating segments or patches of a separable fastening means by simply aligning the fastening means. The '397 patent also discloses a paneling system having panels that can be demounted from the support surface without damage to the panels or the support surface as disclosed in column 2 lines 57-58 of the same. It is further disclosed in column 5 lines 3-5 of the same that hook and loop fasteners are used to secure panels to strips secured to walls. The '397 patent also fails to teach a removable panel system that is capable of preventing accidental detachment nor does it teach a safety measure to prevent dropping of a panel upon detaching from a wall.

U.S. Pat. No. 7,805,899 to Montgomery discloses a high impact, moisture resistant, wall panel system and methods for mounting a high impact, moisture resistant wall panel to an existing structure. Patent '899 details a high impact, moisture resistant wall panel includes an inert substrate composed of a high density inorganic material. The substrate is dimensionally stable. There is further provided a laminate composed of a substantially rigid polymeric material and an adhesive for engaging the laminate to the substrate. According to this disclosure, any given panel in the wall system can be removed without prior removal of panels above or around the panel. This is accomplished by leaving an adequate reveal around each panel so the panel can be lifted and removed. The size of the panel clip engaged with the wall support is smaller than the reveal dimension, thereby allowing the removal of individual panels. As such, a force sufficient to overcome the weight of a panel is enough to dislodge the panel if the force is applied in a direction for detaching the panel. Such attachment is not secure especially when used in a high traffic area. As panels are mounted by engaging fixedly attached panel clips to fixedly attached wall supports, this system is not suitable for mounting tightly placed wall panels of non-rectangular shapes.

U.S. Pat. No. 8,511,014 of Delforte discloses a removable highly secured high impact wall panel mounting system for mounting at least one wall panel having a front face, a rear face and at least one first attachment portion attached to a portion of the rear face, to a wall in an area of high traffic, comprising at least one second attachment portion and at least one joint closure having an elongated strip. The elongated strip includes a longitudinal axis and a substantially rectangular cross-sectional profile including a top wall, a bottom wall and two side walls connecting the top wall to the bottom wall. Each pair of flanges is disposed substantially symmetrically about the longitudinal axis of the strip. In one embodiment, a bottom support bracket is provided to cooperate with a plurality of hooks disposed on a wall panel. Patent '014 details bottom supporting brackets and second attachment portions that are fixedly secured to walls and incapable of slideable movements with respect to the walls.

Thus, there exists a need for a wall panel mounting system that is removable, highly secured wall panel mounting system that is suitable for a high traffic area and easy to install.

SUMMARY OF THE INVENTION

The present invention discloses a removable highly secured wall panel mounting system for covering a wall in a high traffic area. A high traffic area is defined herein as elevator lobbies, corridors, bathrooms, lobbies/atriums, entrance ways, vestibules, cafeterias, patient rooms, gymnasiums, swimming pools, locker rooms, lounges, meeting rooms of commercial office buildings, schools, colleges, universities, hospitals, transportation facilities, mall/retail stores, restaurants, hotels, condominiums, sporting complexes and the like. Disclosed herein is a wall panel mounting system for mounting a wall panel to a wall. A wall panel includes a front face, a rear face and at least one first attachment portion attached to a portion of the rear face. The wall panel mounting system includes at least one second attachment portion, at least one bottom support bracket, at least one hook, at least one rail configured for attachment to the wall and at least one securing plate having a front surface and a rear adaptor configured to be removably and slideably attachable to the rail. Each second attachment portion is disposed on the front surface of the at least one securing plate. Each first attachment portion is configured to be removably attachable to a second attachment portion by a pushing force applied substantially normal to the wall on the front face of the wall panel to generate a tensile attachment pressure to attach the wall panel to at least one securing plate that is in turn slidingly secured to a rail. Each bottom support bracket is configured for attachment to the wall. Each hook is configured for attachment to the wall panel. The hook is configured to be coupled with the bottom support bracket such that a portion of the weight of the wall panel is supported via the hook.

In one embodiment, the removable wall panel mounting system further includes at least one removable crown having an inverted U-shaped channel. Each inverted U-shaped channel includes a top wall and a pair of side walls, each side wall extending from one long edge of the top wall and the side walls are configured to be biased outwardly from one another. The removable crown provides an appearance of sophistication to the wall panels, provides the "finished" look to the wall panels or to mask any imperfections of the gaps between installed wall panels.

In one embodiment, the removable wall panel mounting system further includes at least one standoff attached to a portion of the rear face, the standoff is configured to set the portion of the rear face a distance of about the same as that between the periphery of the wall panel and the wall.

Each first attachment portion is configured to be removably attachable to a second attachment portion by a pushing force of less than 10 lbs. applied substantially normal to the wall on the front face of the wall panel to generate a tensile attachment pressure to attach the wall panel to the at least one securing plates. In one embodiment, the tensile attachment strength ranges from about 50 psi to 75 psi. Each first attachment portion has an attachment surface and a support surface. The attachment surface of the first attachment portion is constructed from reclosable fasteners and the support surface is coated with adhesive. Similarly, each second attachment portion has an attachment surface and a support surface. The attachment surface of the second attachment portion is constructed from reclosable fasteners and the support surface is coated with adhesive. In one embodiment, the first and second attachment portions are identical.

In one embodiment, the wall panel mounting system further comprises at least a standoff attached to a portion of the rear face of a wall panel where the standoff is configured to set the portion of the rear face a distance of about the same as that the periphery of the wall panel from the wall.

In one embodiment, the removable wall panel mounting system further includes a second rail configured for attachment to the wall and a joint closure slideably adapted to the second rail. In one embodiment, the joint closure is spring loaded. In one embodiment, the joint closure includes a flange, a pair of springs and a web connecting the flange at a first end and the pair of springs at a second end. The pair of springs is slideably adapted to a cavity of the second rail such that the distance of the flange from the second rail is alterable with a force applied to the flange.

It is a primary object of the present invention to provide a wall panel mounting system that is simple to manufacture, install and remove.

It is another object of the present invention to provide a wall panel mounting system that is secure and suitable for use in a high traffic area.

It is another object of the present invention to provide a wall panel mounting system that requires minimal modifications and causes minimal damage to a wall on which the wall panel mounting system is attached.

It is another object of the present invention to provide a wall panel mounting system which requires minimal number of parts for securing wall panels.

Whereas there may be many embodiments of the present invention, each embodiment may meet one or more of the foregoing recited objects in any combination. It is not intended that each embodiment will necessarily meet each objective.

Thus, having broadly outlined the more important features of the present invention in order that the detailed description thereof may be better understood, and that the present contribution to the art may be better appreciated, there are, of course, additional features of the present invention that will be described herein and will form a part of the subject matter of the claims appended to this specification.

In this respect, before explaining at least one embodiment of the invention in detail, it is to be understood that the invention is not limited in its application to the details of construction and the arrangements of the components set forth in the following description or illustrated in the drawings. The present invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the conception regarded as the present invention.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
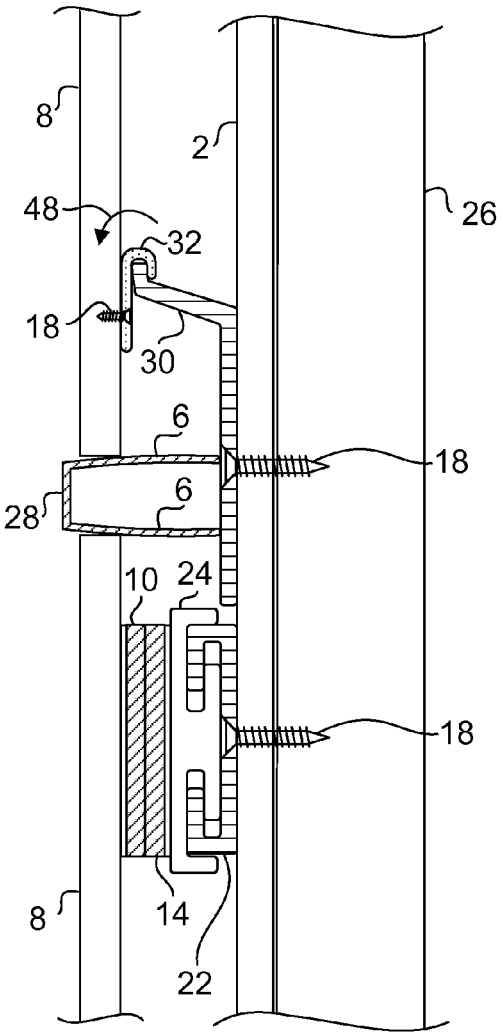
FIG. 1 is a partial cross-sectional side orthogonal view of a wall mounting system where the support hardware of the bottom portion of a top wall panel and the support hardware of the top portion of a bottom wall panel are provided separately.

2—wall
4—strip
6—side wall
8—wall panel
10—attachment portion secured to wall panel
12—supplementary attachment portion secured to wall panel
14—attachment portion secured to securing plate
16—supplementary attachment portion secured to standoff
18—fastener
20—aperture
22—rail
24—securing plate
26—wall stud
28—removable crown
30—bottom support bracket
32—hook
34—standoff
36—engagement height of bottom support bracket
38—engagement width of bottom support bracket
40—engagement height of hook
42—engagement width of hook
44—first longitudinal half of bottom support bracket
46—second longitudinal half of bottom support bracket
48—direction in which wall panel is rotated before the wall panel can be removed from bottom supporting bracket
50—rear lip
52—front lip
54—ridge
56—vertical distance between ridges disposed on opposite walls of hook
58—groove
60—joint closure
62—spring
64—flange
66—web
68—base
70—sleeve

Particular Advantages of the Invention

The present invention provides a wall panel mounting system that is simple to install, removable, highly secured and is suitable for a high traffic area. Upon installation, each wall panel is supported by sealable attachments that create sufficient gap behind the wall panel to inhibit or reduce moisture accumulation and mold growth. Installation is simplified by enabling sufficient play between joint closures and wall panels during installation. Therefore, precise mounting (which is often associated with increased labor and costs) of joint closures with respect to wall panels is not required. Each panel is supported by bottom support brackets fastened into the wall at its bottom periphery. As such, requirement for the sealable attachment may be relaxed, thereby reducing the amount of sealable attachment required.

There is provided a wall panel mounting system which not only provides aesthetic value but also to facilitate installation of wall panels and provide static support to mounted panels.

Upon installation, the wall panel mounting system is installed sufficiently abutted to a wall, leaving no hand holds for effective tampering of installed wall panels. A substantially large tensile force is required to detach a wall panel rendering tampering more difficult. In addition, the wall panel mounting system provides a consistent and aesthetic appearance.

Bottom support brackets are attached at bottom fringes of wall panels in order to support the majority of the wall panel weight when the hooks attached to the wall panels are coupled to these bottom support brackets. As such, this relieves the amount of weight that is required to be supported by the balance of any securing devices. In conjunction with the bottom support brackets, the top fringes of wall panels are still equipped with sealable attachments which enable wall panel removal if necessary. Any installed wall panel may be removed individually without requiring its neighboring panels to be removed first.

Detailed Description of a Preferred Embodiment

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

The present invention is a removable, highly secured wall panel mounting system for wall panels that is suitable for use in high traffic areas. The system comprises a wall panel mounting system which eliminates the need for precision mounting of the same by enabling sufficient play during installation between the mounting system and a wall panel, thereby simplifying installation of the wall panel. The system further comprises a sealable attaching means for securely and sealably attaching the wall panel to the mounting system, thereby eliminating the need for precision mounting of the attaching means and simplifying installation of the wall panel.

Figure 2:
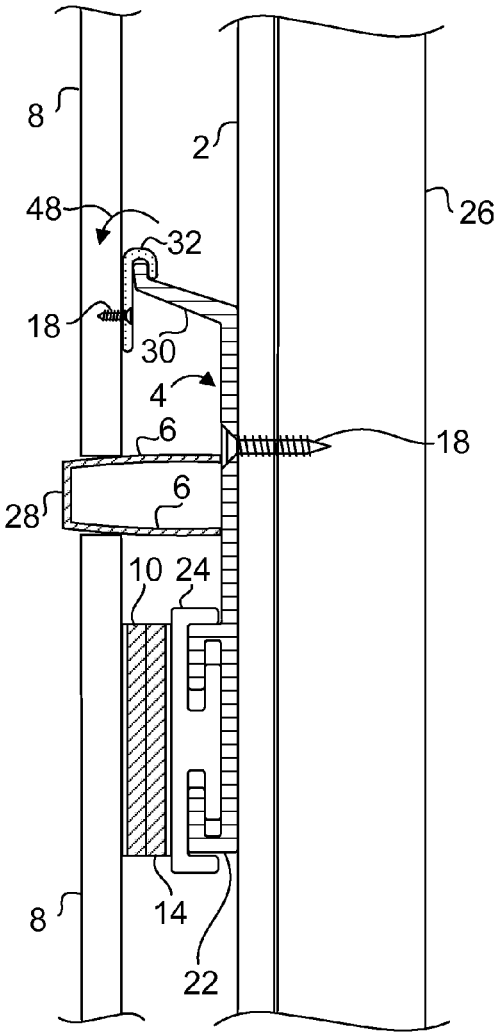
FIG. 2 is a partial cross-sectional side orthogonal view of a wall mounting system where the support hardware of the bottom portion of a top wall panel and the support hardware of the top portion of an adjacently and lower disposed wall panel are provided as a single strip.

As will be demonstrated in FIGS. 4-9, in the wall panel mounting system, various attachment portions, rail and hook combinations are used to secure a plurality of wall panels. FIG. 1 is a partial cross-sectional side orthogonal view of a wall mounting system where the support hardware of the bottom portion of a top wall panel 8 and the support hardware of the top portion of a bottom wall panel are provided in separately. FIG. 2 is a partial cross-sectional side orthogonal view of a wall mounting system where the support hardware of the bottom portion of a top wall panel and the support hardware of the top portion of an adjacently and lower disposed wall panel are provided as a single unit. As such, the bottom support bracket 30 and rail 22 are installable together to reduce labor and the number of hardware parts required to mount wall panels. Referring to FIGS. 1 and 2, a rail 22 is essentially a C-shaped channel.

The removable wall panel mounting system is adapted to mount at least one wall panel to a wall. A wall panel 8 includes a front face, a rear face and at least one first attachment portion 10 attached to a portion of the rear face thereof. The removable wall panel mounting system includes at least one second attachment portion 14, at least one bottom support bracket 30, at least one hook 32 configured for attachment to a portion of the rear face of the wall panel, at least one rail 22 configured for attachment to the wall 2 and at least one securing plate having a front surface and a rear adaptor configured to be removably and slideably attachable to the rail 22. The rear adaptor includes a profile having a shape that is essentially complementary to the cross-sectional profile of the C-shaped channel of the rail 22. In one embodiment, a second attachment portion 14 further includes at least one pre-drilled hole to enable the use of a fastener through the hole to secure the second attachment portion 14 to a rail 22 and possibly into the wall to which the rail 22 is attached. Upon insertion of the rear adaptor, the securing plate is only removable in a direction parallel to the sliding direction of the rear adaptor and not removable in a direction perpendicular to its sliding direction. The securing plate is therefore positively secured with respect to the rail 22 against any attempts to remove wall panels from their attachment points. The second attachment portion 14 is disposed on the front surface of the securing plate 24. The first attachment portion 10 is configured to be removably attachable to the second attachment portion 14 by a pushing force applied substantially normal to the wall 2 on the front face of the wall panel 8 to generate a tensile attachment pressure to attach the wall panel 8 to the rail 22. The bottom support bracket 30 is configured for attachment to the wall 2. The hook 32 is configured to be coupled with the bottom support bracket 30 such that a portion of the weight of the wall panel is supported via the hook 32. In one embodiment, a securing plate 24 measures about 1 inch×3 inches×16 to 18 gauge.

There is further provided removable crowns, each having an inverted U-shaped channel, the inverted U-shaped channel having a top wall and a pair of side walls, each side wall extending from one long edge of the top wall and the side walls are configured to be biased outwardly from one another.

Figure 3:
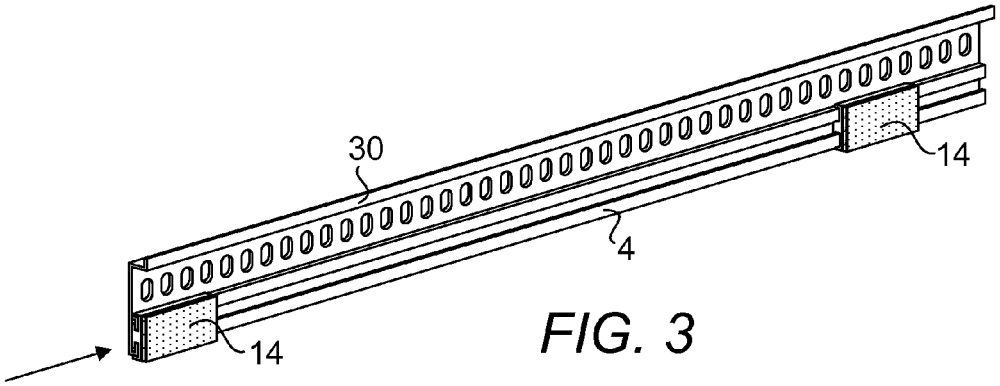
FIG. 3 is a top front perspective view of a wall mounting system where the support hardware of the bottom portion of a top wall panel and the support hardware of the top portion of an adjacently and lower disposed wall panel are provided as a single strip and two securing plates are slideably attached to the wall panel top portion supporting hardware.

FIG. 3 is a top front perspective view of a wall mounting system where the support hardware of the bottom portion of a top wall panel 8 and the support hardware of the top portion of an adjacently and lower disposed wall panel are provided as a single strip and two securing plates 24 are slideably attached to the wall panel top portion supporting hardware. In a preferred embodiment, the supporting hardware for the bottom portion of a wall panel is essentially a rail 22 having a cross-sectional profile sufficient to positively engage a securing plate while allowing it to slide along the rail. In order to positively engage the rail 22, the securing plate 24 is slidingly disposed on the rail 22 by aligning the engaging hardware of the securing plate with one of the two longitudinal ends of rail and inserting the engaging hardware with a receiving hardware of the rail. When positively engaged, the securing plate can only be removed from the rail 22 at one of its ends. Upon complete installation of wall panels on a wall, however, the inadvertent removal of wall panels are discouraged or prevented by walls, frames, inside corner joint closures, outside corner joint closures, etc., which are disposed on the sides of the wall upon which the wall panels are installed. Although not so limited, each strip 4 generally comprises a length of from about 8 feet to about 12 feet to accommodate the height of standard walls. During installation, strips 4 may be cut to a desired length. As will be readily appreciated, where lengths (distances) greater than 12 feet (or the length of any single joint closure) are to be covered, multiple strips 4 are adjacently disposed to form a length exceeding that of the length of a single strip 4.

Figure 4:
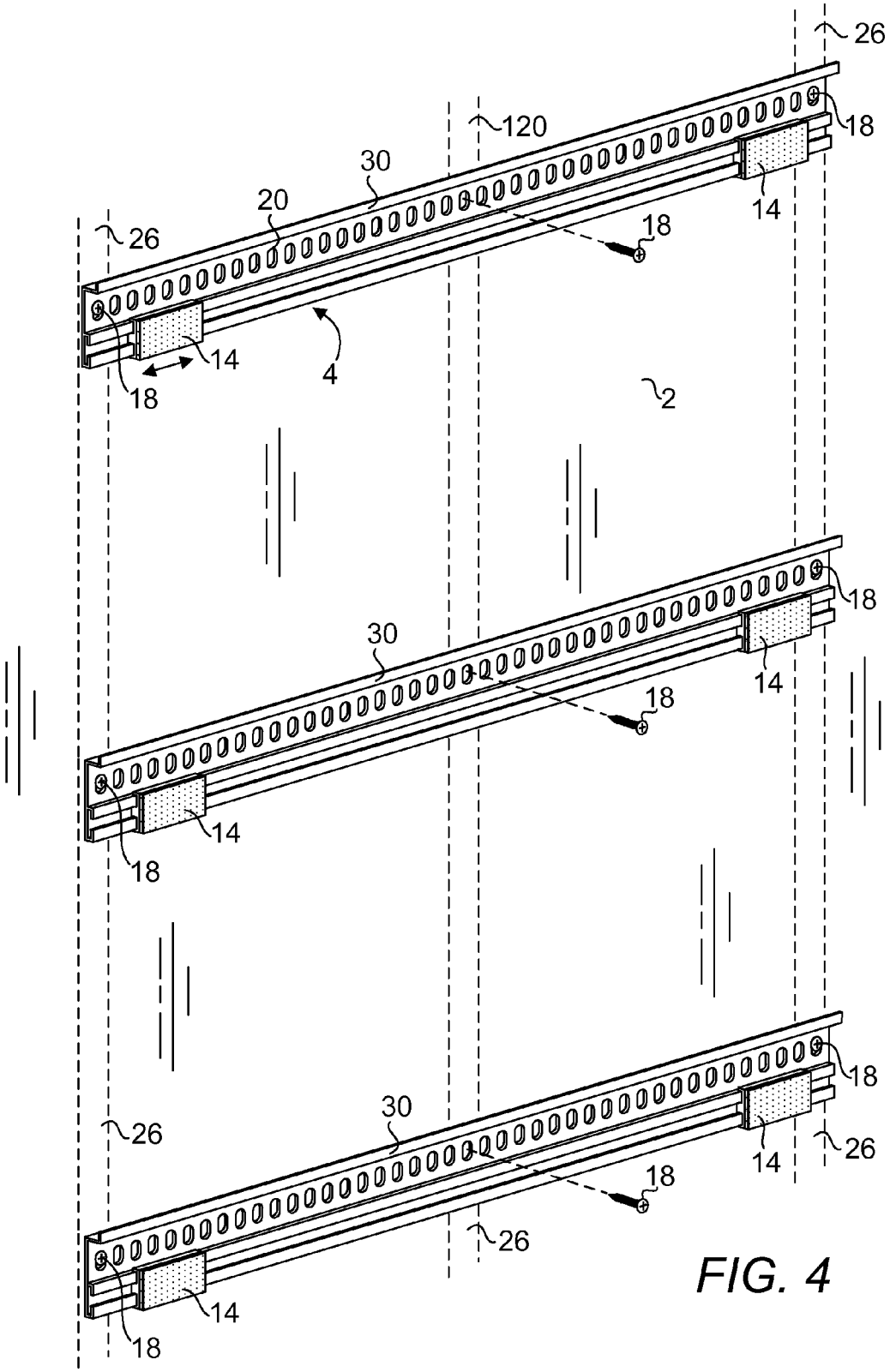
FIG. 4 is a top front perspective view of a wall mounting system where three strips are being secured to a wall.
Figure 5:
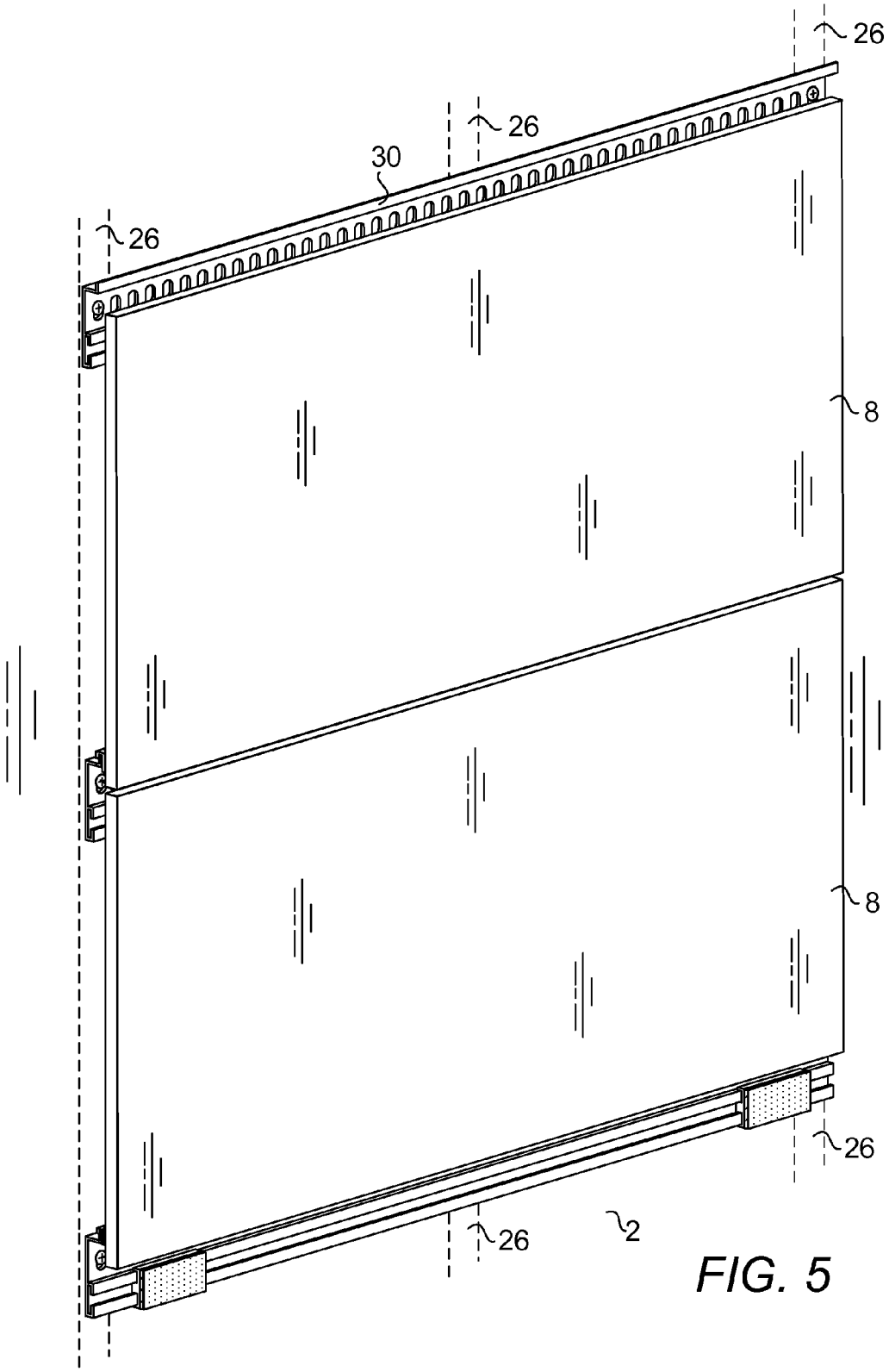
FIG. 5 is a top front perspective view of a wall mounting system where three strips have been secured to a wall and two panels have been secured to the three strips.

FIG. 4 is a top front perspective view of a wall mounting system where three strips 4 are being secured to a wall 2. FIG.

5 is a top front perspective view of a wall mounting system where three strips 4 have been secured to a wall and two panels have been secured to the three strips 4. As shown in this embodiment, each strip 4 includes both a bottom support bracket 30 and a rail 22. Therefore, the installation of one strip 4 yields the result of installing two separately available items, i.e., a bottom support bracket 30 and a rail 22, simplifying the installation process. Each strip 4 shall be installed with the aid of a level, with care being taken to ensure that appropriate allowances are provided at the upper-most or bottom-most strip especially when hooks and second attachment portions have been factory pre-installed.

Figure 6:
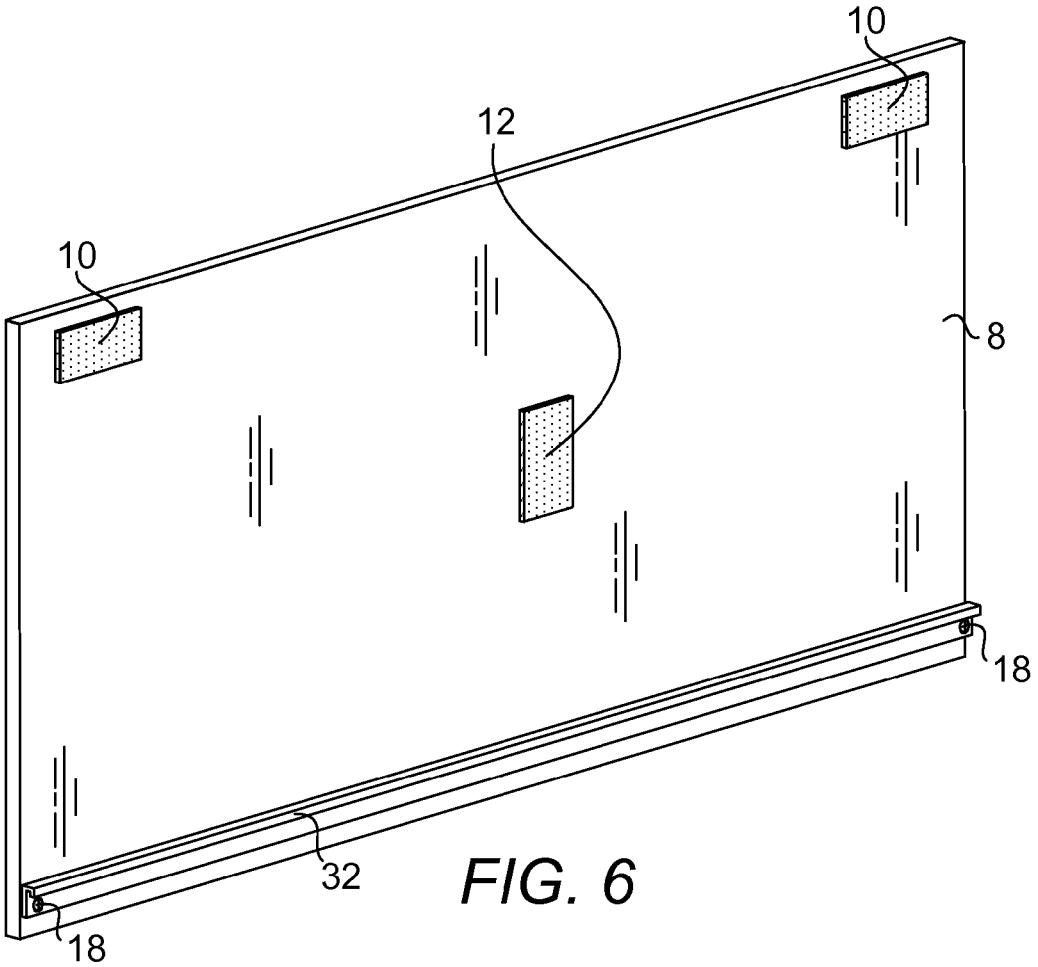
FIG. 6 is a top front perspective view of a wall panel where attachment portions and an elongated hook have been secured to the rear face of the wall panel.
Figure 7:
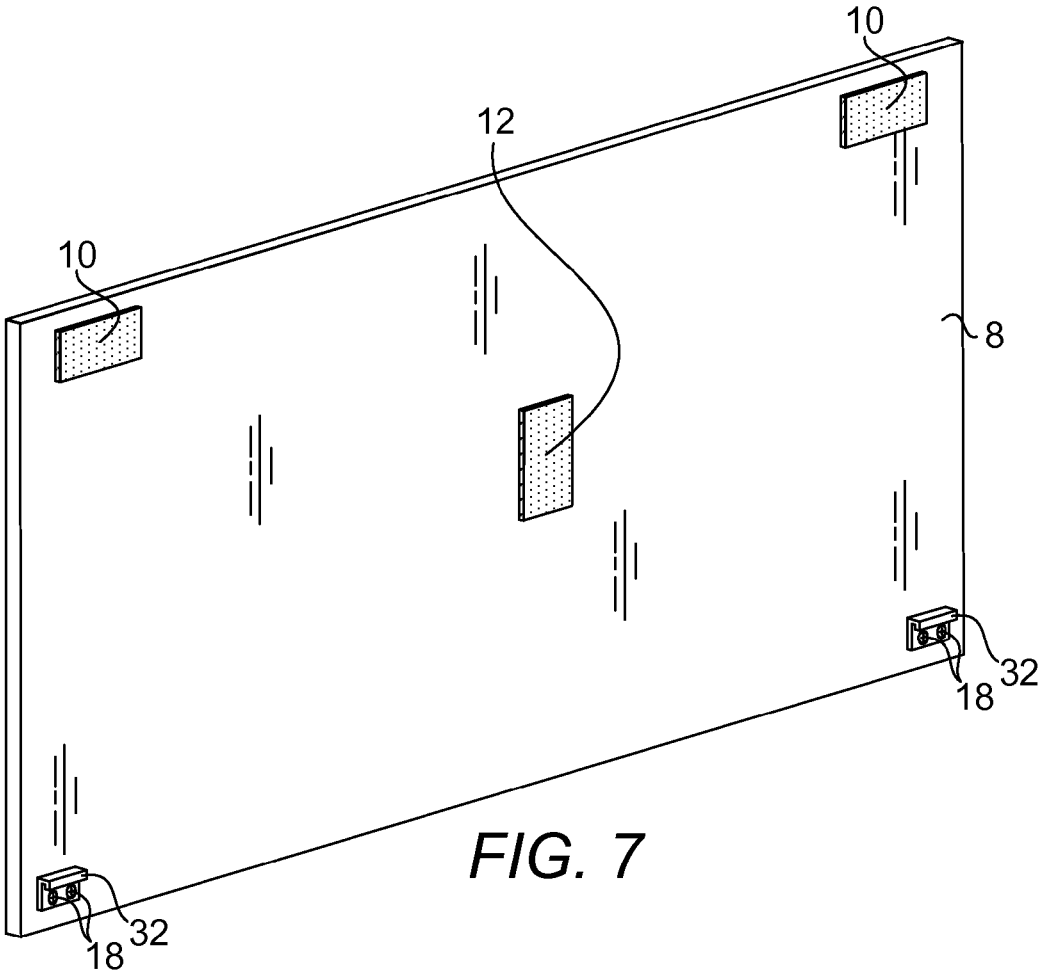
FIG. 7 is a top front perspective view of a wall panel where attachment portions and hooks have been secured to the rear face of the wall panel.

FIG. 6 is a top front perspective view of a wall panel where attachment portions 10 and elongated hook 32 have been secured to the rear face of the wall panel. FIG. 7 is a top front perspective view of a wall panel where attachment portions and hooks 32 have been secured to the rear face of the wall panel. It shall be noted that, when installed, attachment portion 12 is mated to an attachment portion 16 shown in FIG. 8. It shall also be noted that one elongated hook 32 or multiple narrow hooks 32 may be used. A wall panel 8 having a plurality of first attachment portions 10 is positioned such that the plurality of first attachments portions 10 are mated to second attachment portions 14. During installation, each second attachment portion 14 is compressed or impacted against a first attachment portion 10 to sufficiently secure the wall panel 8 to the wall 2.

A plurality of first attachment portions 10 and first supplementary attachment portions 12 are attached to a portion of the rear face of the wall panel 8 so as to be mated with the second attachment portions 14 and second supplementary attachment portions 16, respectively. Each first attachment portion 10 is configured to be removably attachable to the a second attachment portion 14 by a pushing force of less than 10 lbs applied substantially normal (perpendicular) to the wall 2 on the front face of the wall panel 8 to generate a tensile attachment strength to attach the wall panel 8 to the strips 4. In one embodiment, the tensile attachment strength ranges from about 50 psi to 75 psi. In a preferred embodiment, the first, second, first supplementary and second supplementary attachment portions are made of the same materials. Each attachment portion comprises an attachment surface and a support surface. An exemplary attachment surface is 3M Dual Lock Reclosable Fasteners SJ3550 having continuous strips of polyolefin stems with a mushroom shaped top protruding up from the support surface. An exemplary support surface is 3M VHB tape capable of withstanding temperatures of 200 degrees Fahrenheit for 10,000 minutes while remaining intact. In one embodiment, the first attachment portion 10 is identical to the second attachment portion 14.

Figure 8:
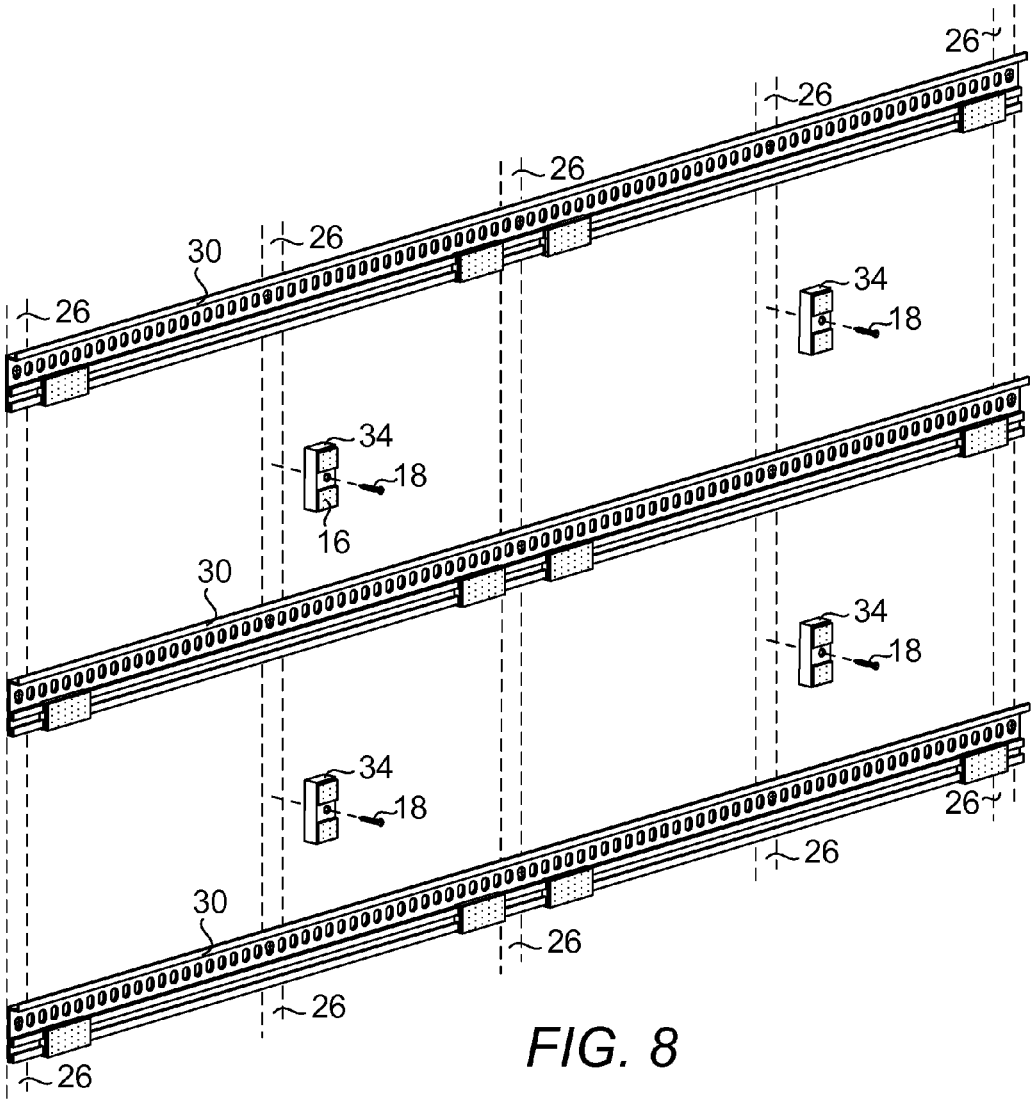
FIG. 8 is a top front perspective view of a wall mounting system where three strips have been secured to a wall and sufficient securing plates have been attached to the strips for accepting four wall panels.
Figure 9:
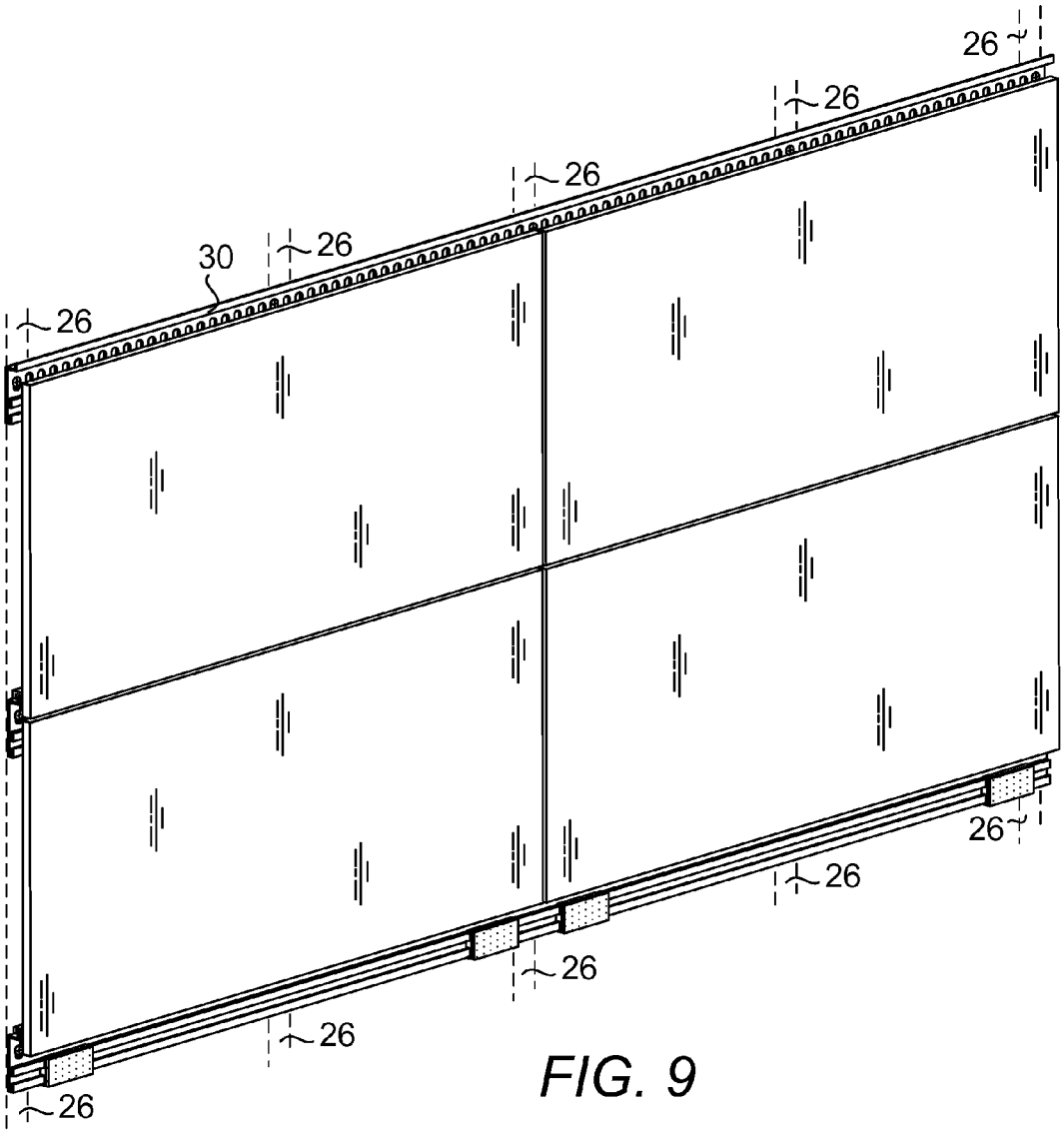
FIG. 9 is a top front perspective view of a wall mounting system where four wall panels having been attached to the wall mounting system of FIG. 8.

FIG. 8 is a top front perspective view of a wall mounting system where three strips have been secured to a wall and sufficient securing plates have been attached to the strips for accepting four wall panels. FIG. 9 is a top front perspective view of a wall mounting system where four wall panels having been attached to the wall mounting system of FIG. 8. It shall be noted that a standoff 34 may also be used to support the center of a wall panel 8 with respect to a wall 2. Wall panels 8, especially natural wood veneered varieties tend to bow in their central portions due to uneven absorption or dissipation of moisture between the central portions and the fringes of wall panels. The standoff 34 can be a piece of foam with its thickness sized such that the distance of the rear face of the wall panel 8 remains consistent at the center of the wall panel 8 as well as the fringes of the wall panel 8 when the standoff 34 is interposed between the wall 2 and the wall panel 8. The standoff 34 may alternatively be affixed to the rear face of the wall panel 8 to ensure that the standoff 34 remains at the center of the wall panel 8. If a standoff 34 is affixed to a wall, a vacuum lifter disclosed elsewhere herein, shall be used if the wall panel 8 were to be removed as the standoff 34 is incapable of sliding laterally. Typical distances between wall studs might be 12-18 inches, although they may not be so limited. Preferably, strips 4 are secured in alignment with wall studs 26. During installation, a wall stud 26 is first located. A plurality of apertures 20 disposed at regular intervals may be provided to facilitate the use of fasteners 18 to secure the strip 4 to the wall 2. A strip 4 is then positioned against a wall 2 and disposed in a levelled configuration. A fastener 18 is then positioned through an aperture 20 of the strip 4, securing the strip 4 to the wall stud 26. Another wall stud 26 is then located and the strip 4 secured to newly located stud 26. As will be appreciated by those skilled in the art, for applications where the supporting wall 2 is sufficiently stiff throughout (such as, for example, a plywood wall), reliance on securing fasteners 18 to a stud is minimized.

During installation of a wall panel 8, one or more hooks 32 mounted on the wall panel 8 are first aligned and mated with bottom support brackets 30 before the wall panel 8 is pushed towards the wall 2 such that the top edge of the wall panel 8 equipped with attachment portions 10 may be mated with the attachment portions 14 secured to the securing plate 24. In order to remove the wall panel 8, attachment portion 10 is detached in direction 48 from attachment portion 14 at the top edge of the wall panel 8. The bottom support bracket 30 may be constructed from aluminum, steel and other sufficiently rigid materials. In order to provide a bottom support bracket 30 that is visually consistent with its surroundings, the bottom support bracket 30 may be painted or anodized with a color similar to that of a removable crown 28. The bottom support bracket 30 may also be extruded or injection molded with other metal or polymeric materials.

Figure 10:
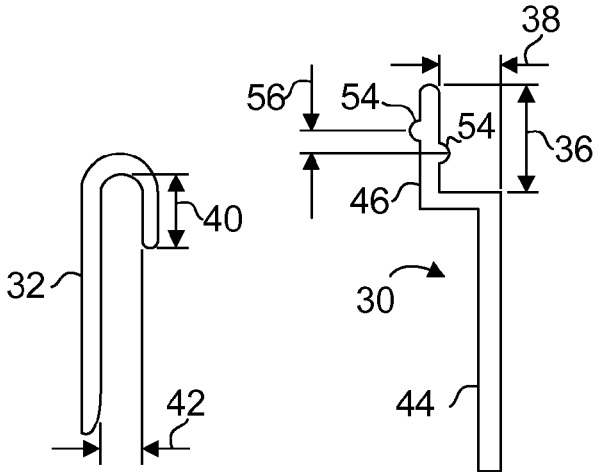
FIG. 10 is a side orthogonal view of a bottom support bracket and a corresponding hook, depicting their exemplary dimensions.

FIG. 10 is a side orthogonal view of a bottom support bracket 30 and a corresponding hook 32, depicting their exemplary dimensions. The engagement height 40 and width 42 of the hook 32 preferably ranges from about ¼ inch to about ⅜ inch and about 0.093 inch, respectively. The engagement height 36 and width 38 of the bottom support bracket 30 preferably ranges from about ½ inch to about ⅝ inch and from about 3/16 inch to about ¼ inch, respectively. The bottom support brackets 30 are especially useful when the size and weight of wall panels supported are a concern. Bottom support brackets 30 may be secured to the wall 2 using a plurality of fasteners 18 at bottom edges of a frame configured to accommodate a wall panel. The bottom support brackets 30 are disposed on and secured to the wall 2 directly, preferably to wall studs 26. A bottom support bracket 30 is essentially an elongated plate longitudinally bent at appropriate spots in a manner such that a surface of a first longitudinal half 44 of the elongated plate is disposed parallel to but at an offset from the second longitudinal half 46 of the elongated plate. One or more hooks 32 are preferably secured to the rear face of the wall panel 8 with fasteners 18 using a jig that ensures the mounting locations of the hooks 32 are consistent with respect to the bottom ledge of the wall panel 8. It shall also be noted that ridges 54 are provided, one on each side of the second longitudinal half 46. Such ridges 54 enable rotation of the hook 32 with respect to the second longitudinal half 46 as shown elsewhere herein such that the wall panel 8 can be removed upon detaching the securing means to top edges of the wall panel 8. There have been concerns with respect to wall panel thickness suitable for use with such means for securing wall panels. In one embodiment, the vertical distance 56 between the two ridges is preferably about 0.116 inch. The Applicant discovered that, in one embodiment, wall panels of about ⅜ inch thick and screws capable of penetration of about 0.23 inch deep in the wall panels 8 work well.

Figure 11:
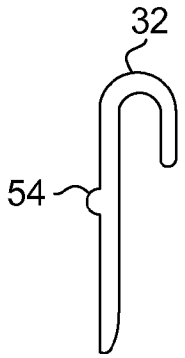
FIG. 11 is a side orthogonal view of another embodiment of a hook, depicting a ridge configured to be coupled to a groove disposed on the rear face of a wall panel.
Figure 12:
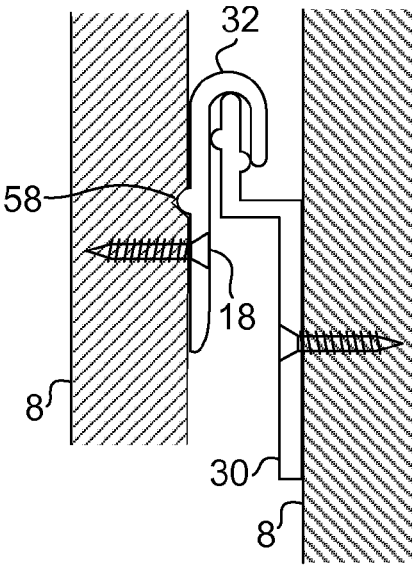
FIG. 12 is a partially transparent partial cross-sectional view of the embodiment of the hook of FIG. 11 as secured to the rear face of a wall panel and coupled to a bottom support bracket.
Figure 13:
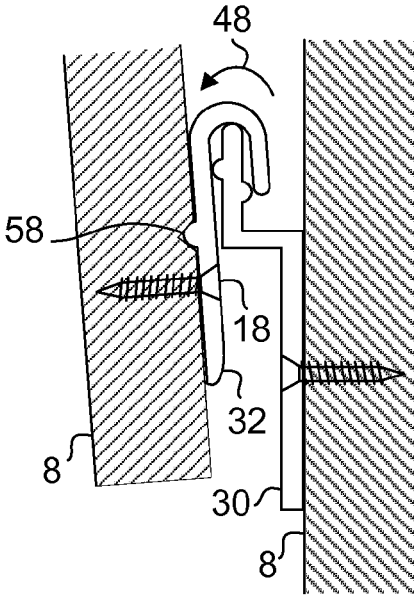
FIG. 13 depicts a direction in which the hook of FIG. 12 is capable of being rotated with respect to its corresponding bottom support bracket.

FIG. 11 is a side orthogonal view of another embodiment of a hook, depicting a ridge 54 configured to be coupled to a groove 58 disposed on the rear face of a wall panel 8. FIG. 12 is a partially transparent partial cross-sectional view of the embodiment of the hook 32 of FIG. 11 as secured to the rear face of a wall panel 8 and coupled to a bottom bracket 30. FIG. 13 depicts a direction 48 in which the hook 32 of FIG. 12 is capable of being rotated with respect to its corresponding bottom support bracket 30. The groove 58 sufficient to accommodate the ridge 54 may be pre-formed at factory, e.g., by cutting the rear face of the wall panel 8 such that when installed, the outer surface of hook 32 facing the rear face of the wall panel 8 can remain flush with the rear face of the wall panel 8. The groove 58 is provided to ensure that a corresponding hook 32 may be expediently and correctly aligned and installed onto the rear face of the wall panel 8.

Figure 14:
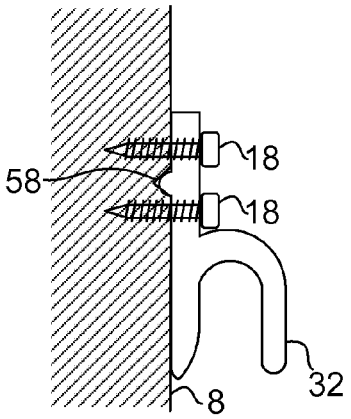
FIG. 14 is a side orthogonal view of yet another embodiment of a hook.

FIG. 14 is a side orthogonal view of yet another embodiment of a hook 32. The generally inverted U-shaped portion of the hook 32 is retained. It shall however be noted that in this embodiment, the surface of the hook 32 through which fasteners 18 are used to secure the hook 32 to the wall panel 8 is disposed at a location free from any interactions with a bottom support bracket 30. The apertures for fasteners 18 therefore do not need to be countersunk, reducing the number of steps required to manufacture the hooks 32.

Figure 15:
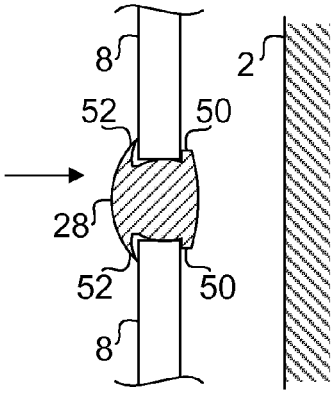
FIG. 15 is a partial cross-sectional view of another embodiment of a removable crown.

FIG. 15 is a partial cross-sectional view of another embodiment of a removable crown 28. In this embodiment, the removable crown 28 is equipped with two front lips 52 disposed on the front face of the removable crown 28 and two rear lips 50 disposed on the rear face of the removable crown 28. In installing this removable crown 28 in a gap between two wall panels 8, the removable crown 28 is forced into this gap with its rear face facing the gap, compressing the removable crown 28 including its rear lips 50, until the rear face of the removable crown 28 exits the other end of the gap. The cross-sectional dimensions of the removable crown 28 are configured such that when the removable crown 28 is installed, the front and rear lips 52, 50 fit snugly on the front and rear faces of the wall panels 8, concealing the gap.

Figure 16:
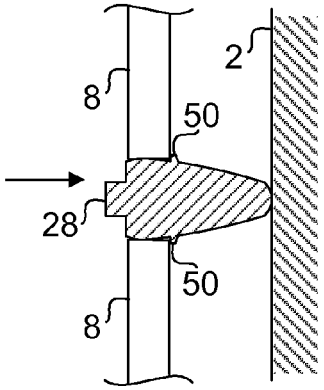
FIG. 16 is a partial cross-sectional view of yet another embodiment of a removable crown.

FIG. 16 is a partial cross-sectional view of yet another embodiment of a removable crown 28. This embodiment is similar to the embodiment shown in FIG. 15, with the exception that, when installed, no front lips are available to restrain the removable crown 28 from entering the gap too deeply. Instead, the removable crown 28 is configured such that its rear end butts against a wall 2 when installed. In both embodiments shown in FIGS. 15 and 16, the removable crowns 28 are preferably made from resilient materials such that the rear lips 50 may be compressed and deformed to fit a gap between wall panels 8 and resume their relaxed form upon their release.

In one embodiment, an inside corner joint closure is used to interconnect two perpendicularly disposed wall panels 8 and attaches to an inside corner formed by two walls 2. Reference is made to U.S. Pat. No. 8,407,955 of Delforte where the disclosure of an inside corner joint closure is incorporated by reference herein. In one embodiment, an outside corner joint closure is used to interconnect two wall panels 8 and attaches to an outside corner formed by two walls 2. Reference is made to U.S. Pat. No. 8,407,955 of Delforte where the disclosure of an outside corner joint closure is incorporated by reference herein.

Damaged or obsolete wall panels may need to be periodically removed. Reference is made to U.S. Pat. No. 8,407,955 of Delforte for a vacuum lifter suitable for use to remove an installed wall panel according to the present invention, the disclosure of vacuum lifter is incorporated by reference herein.

Figure 17:
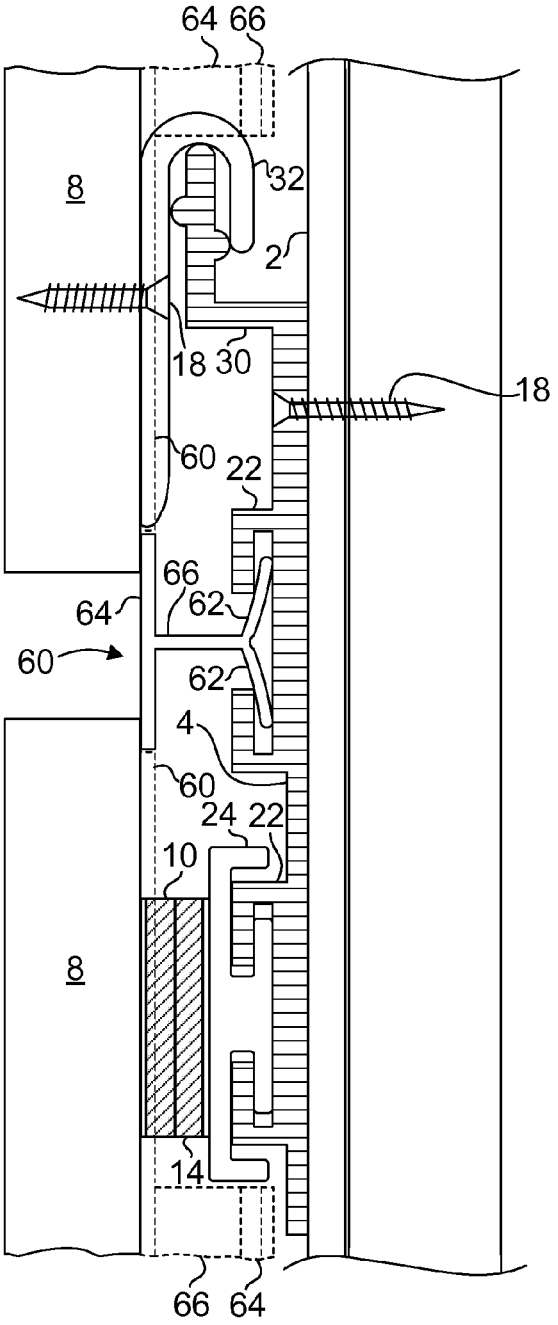
FIG. 17 is a partial cross-sectional side orthogonal view of a wall mounting system where a second rail is configured to accommodate a joint closure.
Figure 18:
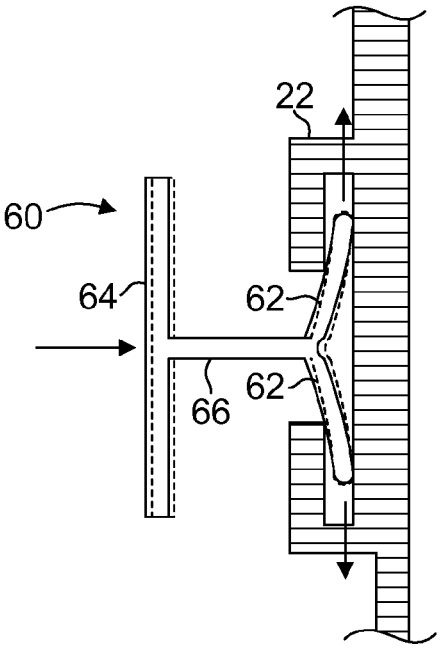
FIG. 18 is a close-up partial cross-sectional side orthogonal view of the joint closure of FIG. 17 shown mounted to the second rail.

FIG. 17 is a partial cross-sectional side orthogonal view of a wall mounting system where a second rail 22 is configured to accommodate a joint closure 60. FIG. 18 is a close up partial cross-sectional side orthogonal view of the joint closure 60 of FIG. 17 shown mounted to the second rail 22. It shall be noted that the second rail 22 is used to hold a joint closure 60 where the second rail 22 is provided as part of a strip. It is conceivable that the second rail 22 is provided individually or separately from other parts. The joint closure 60 has a cross-sectional profile that is similar to an I-beam with the exception that the bottom flange has been replaced instead with a pair of springs 62. A flange 64 is supported by a web 66 and the pair of springs 62 is connected to the web 66. It shall be understood that the joint closure 60 is elongated, i.e., it extends into the sheet, much like the strip 4. In use, the joint closure 60 is constructed such that its flange 64 is capable of being abutted against a portion of the rear faces of wall panels 8 with a small pressure applied via the springs 62, concealing the wall surfaces behind the wall panels 8. Referring to FIG. 18, while the springs 62 of the joint closure 60 are seated within the second rail and when pressured against the wall 2, the springs 62 will flex, flattening into the cavities of the second rail with the flange 64 disposed closer to the wall 2. Therefore, the joint closure 60 can be urged against installed wall panels 8, eliminating any gaps which may form due to imperfect installations of the wall panels.

The joint closure 60 is preferably fabricated from a resilient material, e.g., plastic, metal. It shall be noted that in order to fully cover vertical and horizontal joints, joint closures 60 may be disposed horizontally and vertically. Portions of the joint closures 60, e.g., webs 66 and springs 62, may be removed to accommodate or clear strips 4, leaving only portions of flanges 64 to conceal strips 4 underneath the flanges 64. For vertically disposed joint closures 60, individually available second rails 22 may be used instead of strips 4 having all the features shown in FIG. 17. It shall be noted that, with a large wall panel, a combination of a rail 22, securing plate 24, attachment portions 10, 14 may be appropriately secured to the wall panel and the wall to which the wall panel is attached to provide additional support to the center portion of the wall panel. When this combination is in use instead of standoff 34, the additional support is slideable to ease installation and detachment of the wall panel while the wall panel is being supported.

Figure 19:
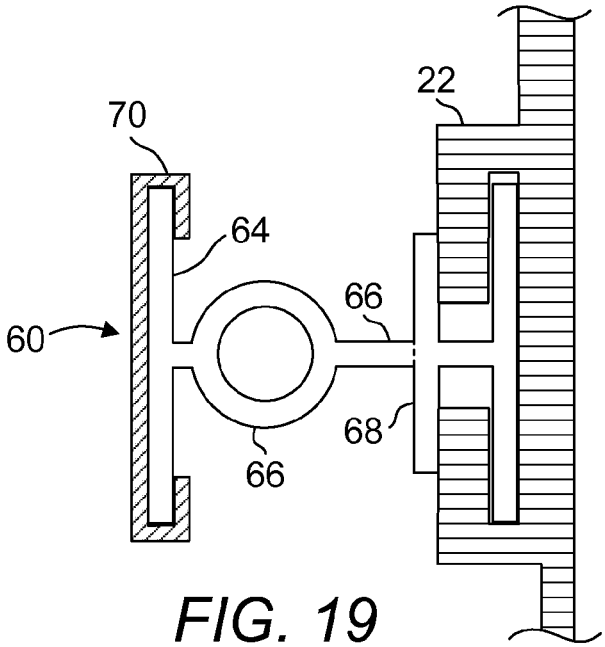
FIG. 19 is a close-up partial cross-sectional side orthogonal view of another embodiment of a joint closure.

FIG. 19 is a close-up partial cross-sectional side orthogonal view of another embodiment of a joint closure 60. The joint closure 60 includes a flange 64, a base 68 slideably adapted to a cavity of said second rail 22 and a web 66 connecting the flange 64 and the base 68. In the embodiment shown, the web 66 further includes a spring 62 configured to allow positional adjustment of the flange 64 with respect to the base 68.

In the embodiment shown, the spring 62 is provided in the shape of a circle. In one embodiment, the joint closure 60 is formed of a single material, e.g., plastic. In another embodiment, the joint closure 60 is formed of more than one material, e.g., by co-extruding soft plastic to form the web 66 and hard plastic to form the flange 64 and the base 68. In one embodiment, a sleeve 70 is further provided where the sleeve 70 is configured to slide over and cover the flange 64 to provide a desired look. Such sleeve may be constructed from aluminum, plastic, etc.

It is also conceivable to reverse the locations of the rail and the bottom support bracket shown in FIG. 2 such that the upper portion of a wall panel is secured using a first and second attachment pairs while the lower portion of a wall panel is secured using a hook and bottom support bracket pair.

It will be appreciated by those skilled in the art that while the invention has been described above in connection with particular embodiments the invention is not necessarily so limited and that numerous other embodiments, uses, modifications and departures from the embodiments, and uses may be made without departing from the inventive concepts.

I claim:

1. A removable wall panel mounting system for mounting at least one wall panel to a wall, the at least one wall panel having a front face, a rear face and at least one first attachment portion attached to a portion of the rear face thereof, said removable wall panel mounting system comprising:

(a) at least one second attachment portion;

(b) at least one bottom support bracket;

(c) at least one hook configured for attachment to a portion of the rear face of the at least one wall panel;

(d) at least one rail configured for attachment to the wall;

(e) at least one securing plate having a front surface and a rear adaptor configured to be removably and slideably attachable to said at least one rail, said at least one second attachment portion is disposed on said front surface of said at least one securing plate; and (f) at least one second rail configured for attachment to the wall and a joint closure slideably adapted to said at least one second rail, wherein the at least one first attachment portion is configured to be removably attachable to said at least one second attachment portion by a pushing force applied substantially normal to the wall on the front face of the at least one wall panel to generate a tensile attachment pressure to attach the at least one wall panel to said at least one rail, and wherein said at least one bottom support bracket is configured for attachment to the wall, and wherein said at least one hook is configured to be coupled with said at least one bottom support bracket such that a portion of the weight of the wall panel is supported via said at least one hook.

2. The removable wall panel mounting system of claim 1, wherein said at least one bottom support bracket and said at least one rail are provided as a single unit such that said at least one bottom support bracket and said at least one rail are installable together to reduce labor.

3. The removable wall panel mounting system of claim 1, wherein said tensile attachment pressure ranges from about 50 pounds to 75 pounds per square inch of said at least one first attachment portion.

4. The removable wall panel mounting system of claim 1, wherein said at least one first attachment portion comprises an attachment surface and a support surface, said attachment surface of said at least one first attachment portion is constructed from reclosable fasteners and said support surface of said at least one first attachment portion is coated with adhesive.

5. The removable wall panel mounting system of claim 1, wherein said at least one second attachment portion comprises an attachment surface and a support surface, said attachment surface of said at least one second attachment portion is constructed from reclosable fasteners and said support surface of said at least one second attachment portion is coated with adhesive.

6. The removable wall panel mounting system of claim 1, further comprising at least a standoff configured for attachment to a portion of the rear face, said standoff is configured to set said portion of said rear face a distance of about the same as that between the periphery of the at least one wall panel and the wall.

7. The removable wall panel mounting system of claim 1, wherein said joint closure is spring loaded.

8. The removable wall panel mounting system of claim 1, wherein said joint closure comprises a flange, a pair of springs and a web connecting said flange at a first end and said pair of springs at a second end, wherein said pair of springs is slideably adapted to a cavity of said second rail such that the distance of said flange from said second rail is alterable with a force applied to said flange.

9. The removable wall panel mounting system of claim 1, wherein said joint closure comprises a flange, a base slideably adapted to a cavity of said second rail, a web connecting said flange and said base, and said web further comprises a spring configured to allow positional adjustment of said flange with respect to said base.

10. A removable wall panel mounting system for mounting at least one wall panel to a wall, the at least one wall panel having a front face, a rear face and at least one first attachment portion attached to a portion of the rear face thereof, said removable wall panel mounting system comprising:

(a) at least one second attachment portion;

(b) at least one bottom support bracket;

(c) at least one hook configured for attachment to a portion of the rear face of the at least one wall panel;

(d) at least one rail configured for attachment to the wall;

(e) at least one securing plate having a front surface and a rear adaptor configured to be removably and slideably attachable to said at least one rail, wherein said at least one second attachment portion is disposed on said front surface of said at least one securing plate; and (f) at least one second rail configured for attachment to the wall and a joint closure slideably adapted to said at least one second rail, wherein the at least one first attachment portion is configured to be removably attachable to said at least one second attachment portion by a pushing force applied substantially normal to the wall on the front face of the at least one wall panel to generate a tensile attachment pressure to attach the at least one wall panel to said at least one rail, said at least one bottom support bracket is configured for attachment to the wall, said at least one hook is configured to be coupled with said at least one bottom support bracket such that a portion of the weight of the wall panel is supported via said at least one hook and said at least one bottom support bracket and said at least one rail are provided as a single unit such that said at least one bottom support bracket and said at least one rail are installable together to reduce labor.

11. The removable wall panel mounting system of claim 10, wherein said at least one first attachment portion comprises an attachment surface and a support surface, said attachment surface of said at least one first attachment portion is constructed from reclosable fasteners and said support surface of said at least one first attachment portion is coated with adhesive.

12. The removable wall panel mounting system of claim 10, wherein said at least one second attachment portion comprises an attachment surface and a support surface, said attachment surface of said at least one second attachment portion is constructed from reclosable fasteners and said support surface of said at least one second attachment portion is coated with adhesive.

13. The removable wall panel mounting system of claim 10, further comprising at least a standoff configured for attachment to a portion of the rear face, wherein said standoff is configured to set said portion of said rear face a distance of about the same as that between the periphery of the at least one wall panel and the wall.

14. The removable wall panel mounting system of claim 10, wherein said joint closure is spring loaded.

15. The removable wall panel mounting system of claim 12, wherein said joint closure comprises a flange, a pair of springs and a web connecting said flange at a first end and said pair of springs at a second end, wherein said pair of springs is slideably adapted to a cavity of said second rail such that the distance of said flange from said second rail is alterable with a force applied to said flange.

16. The removable wall panel mounting system of claim 10, wherein said joint closure comprises a flange, a base slideably adapted to a cavity of said second rail, a web connecting said flange and said base, and said web further comprises a spring configured to allow positional adjustment of said flange with respect to said base.

* * * * *